United States Patent [19]

Hernandez

[11] Patent Number: 4,993,719

[45] Date of Patent: Feb. 19, 1991

[54] PORTABLE SELF-CONTAINED VOLLEYBALL NET

[76] Inventor: Tirso R. Hernandez, 630 E. Ogden St., Milwaukee, Wis. 53202

[21] Appl. No.: 558,162

[22] Filed: Jul. 25, 1990

[51] Int. Cl.[5] ..... A63B 61/00

[52] U.S. Cl. ..... 273/411; 273/29 B

[58] Field of Search ..... 273/411, 29 B, 29 BB, 273/29 BC

[56] References Cited

U.S. PATENT DOCUMENTS

| | | | |
|---|---|---|---|
| 349,686 | 9/1886 | Braithwaite et al. | 273/29 BG |
| 906,848 | 12/1908 | Atwell | 273/29 BG |
| 1,300,972 | 4/1919 | Janssen | 273/29 BG |
| 1,526,126 | 2/1925 | Fitzherbert | 273/29 BF |
| 3,328,928 | 7/1967 | Frye | 273/411 X |
| 3,938,806 | 2/1976 | Husbands | 273/411 |
| 4,088,317 | 5/1978 | Gierla | 273/29 B X |
| 4,415,163 | 11/1983 | Schoenig | 273/411 |
| 4,595,155 | 6/1986 | Gough | 273/29 BD X |
| 4,720,112 | 1/1988 | Stettner et al. | 273/411 |
| 4,830,382 | 5/1989 | Wheeler | 273/411 |

*Primary Examiner*—William H. Grieb

*Attorney, Agent, or Firm*—Andrus, Sceales, Starke & Sawall

[57] ABSTRACT

A portable volleyball net assembly is constructed of tough, high strength plastic and includes two cylindrical housings within each of which is stored one-half of the net and a telescoping supporting post assembly. The net is attached to a rotatable tube within the housing from which it may be extended through a longitudinal housing slot and around which it may be rerolled by manually turning an end cap attached to the tube on the outside of the housing. The telescoping post assembly preferably includes two tubular sections adapted to be withdrawn from the rotatable net-supporting tube and locked into their extended positions to fix the height of the net. The overlapping ends of two of the tubular sections includes axially positionable locking slots to establish varying net heights. The lowermost tubular telescoping post member has an anchoring spike rotatably attached to it which may be screwed into the ground to anchor the post without rotation of the rest of the assembly. When the post assemblies and net are retracted into the housings for storage, the two housings may be joined at the abutment of the net deployment slots and secured together with a hinged plastic harness having a handle to facilitate transport. A supplemental guy line assembly is also provided.

11 Claims, 4 Drawing Sheets

FIG. 1
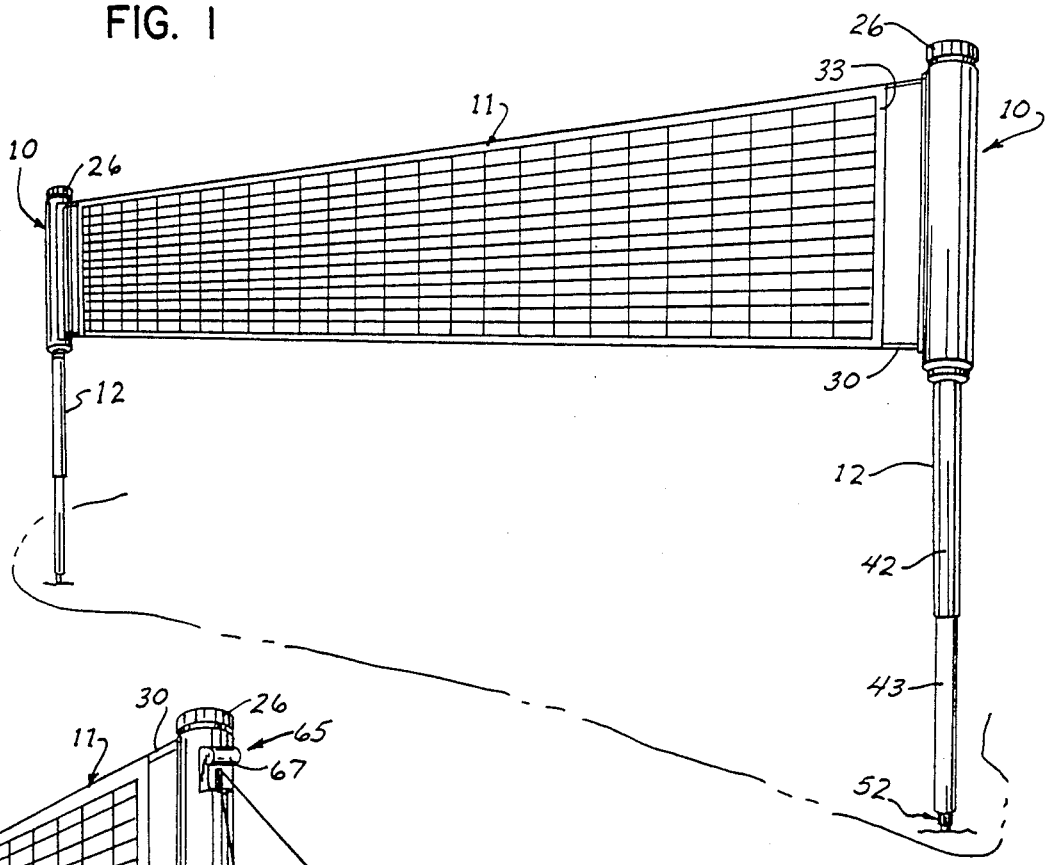
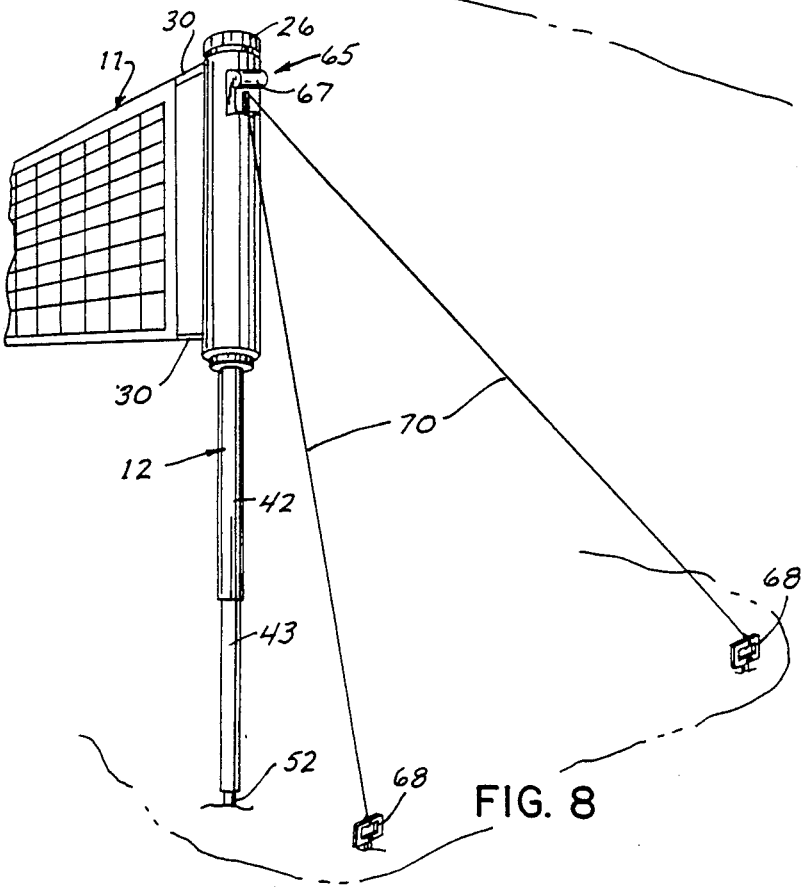
FIG. 8
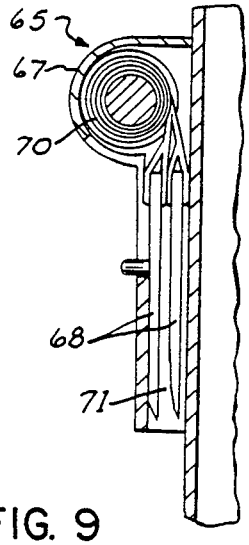
FIG. 9

FIG. 2
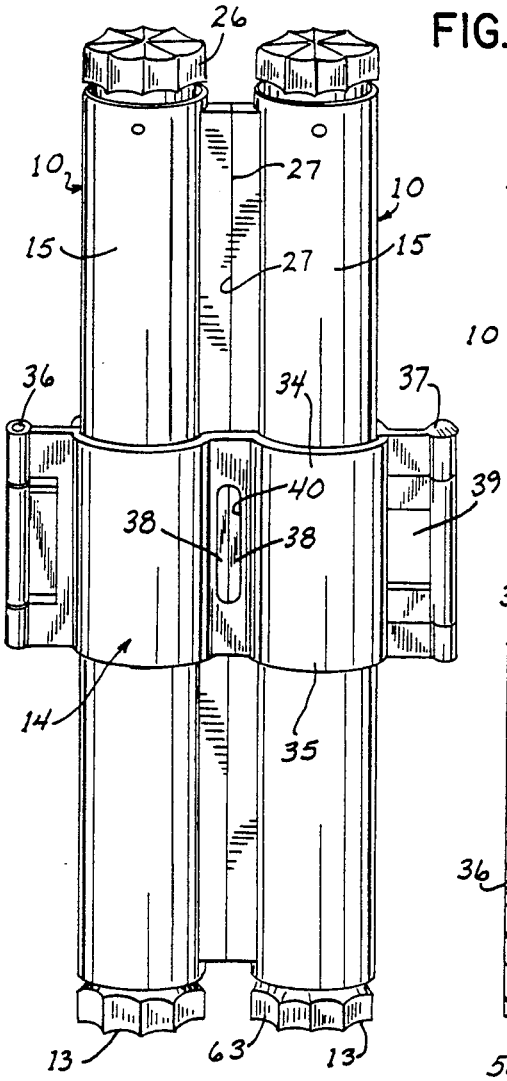
FIG. 3
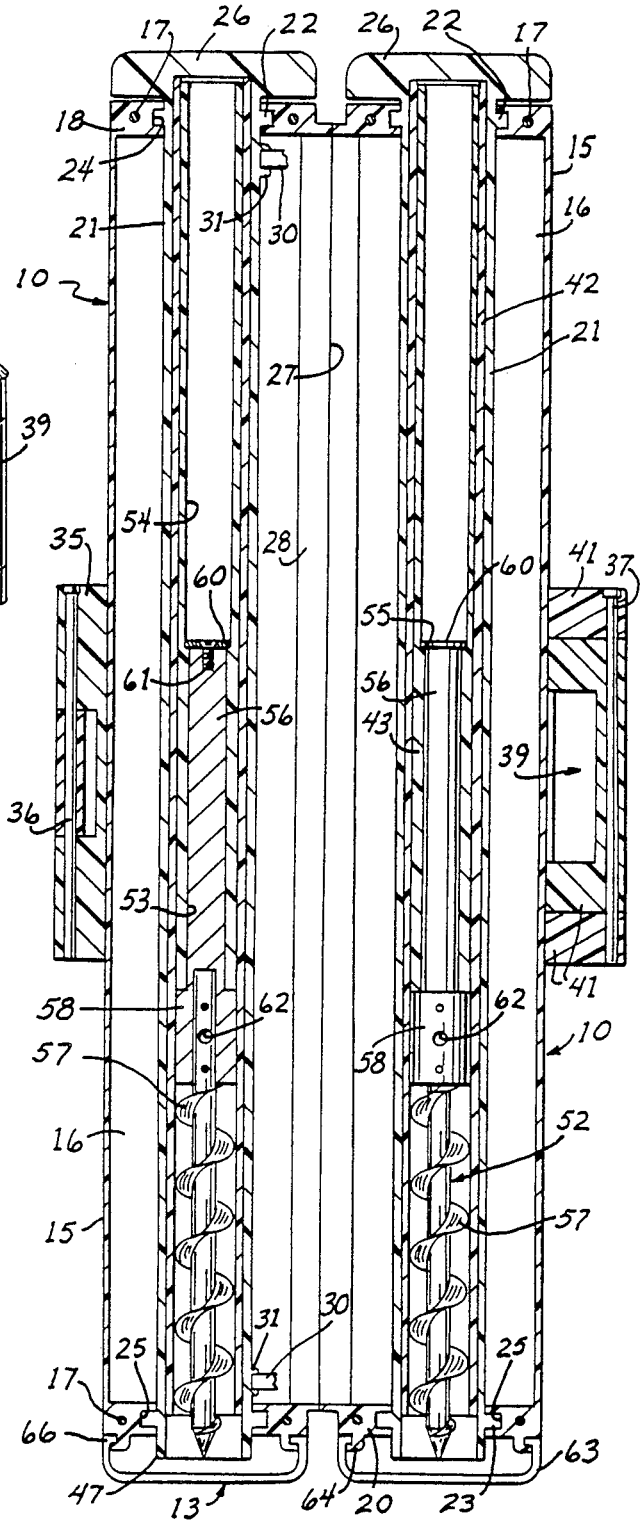
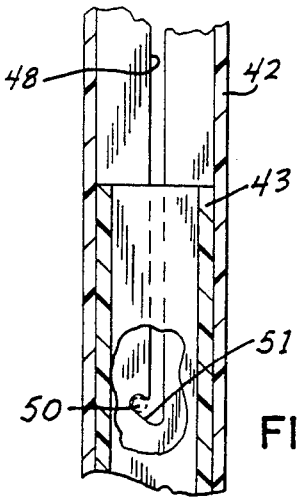
FIG. 6

PORTABLE SELF-CONTAINED VOLLEYBALL NET

BACKGROUND OF THE INVENTION

The present invention pertains to a portable volleyball net assembly and, more particularly, to such an assembly in which the net and the opposite supporting legs are deployable from a pair of identical tubular housings in which the entire assembly may be stored and transported when not in use.

Nets and supporting apparatus for volleyball and similar types of games which are deployable from some type of storage container are well known in the art. In particular, many devices of this type have been devised for the storage of tennis nets, some comprising permanently affixed storage units and others portable storage units. Examples of the former are shown in U.S. Pat. Nos. 1,526,126 and 4,595,155 and U.K. Pat. No. 23993. Examples of the latter are shown in U.S. Pat. Nos. 906,848; 1,300,972; and 4,088,317.

In previously identified U.S. Pat. No. 4,595,155 and U.K. Pat. No. 23993, one of two permanently installed net supporting posts comprises a manually operable reel mechanism into which the tennis net may be rolled after the opposite end is disconnected from the other supporting post. In previously identified U.S. Pat. No. 1,526,126, the net reeling apparatus in one of the supporting posts comprises a spring biased roller which retracts and rolls up the net in the manner similar to a window shade.

In U.S. Pat. No. 906,848, a tennis net is manually wound onto a shaft in a semicylindrical post member and enclosed for storage therein by a similar semicylindrical post member, each of which semicylindrical post members includes a demountable stake which may be driven into the ground and to which the post members are attachable after unreeling the net. In U.S. Pat. No. 1,300,972, a tubular net carrying housing is attachable to a permanent net supporting post or the like and the net may be drawn from the housing against the bias of a rewind spring with the free end of the net attached to an opposite permanent supporting post or the like. In U.S. Pat. No. 4,088,317 two similar portable tubular housings are utilized, one of which includes a reel mechanism for storing the net and providing one net supporting post and the other provides the other net supporting post.

Screw type anchors which may be threadably driven into the ground and to which tennis net supporting end posts may be attached are shown in U.K. Pat. Nos. 19270 and 525,395. In both of the foregoing patents, the anchor screws are separately driven into the ground and the end posts are then mounted thereon.

U.S. Pat. Nos. 4,720,112 and 4,830,382 both disclose systems for supporting a volleyball net including telescoping net supporting standards or end posts. The system disclosed in the latter patent is intended to be portable and, although the telescoping supporting standards facilitate portability, no provision is made for rolling and storing the net.

The prior art described above discloses portable game net assemblies in which certain components of the assembly may be stored in and deployed from an enclosing housing which housing may also be utilized as one or both of the net-supporting end posts. In none of the identified prior art patents, however, is there a disclosure of a completely self-contained portable volleyball net assembly in which telescoping end posts with anchoring spikes are fully storable, along with the attached net, within a pair of tubular housing members and from which housing members the net and telescoping post assemblies are directly deployable. It would be desirable, therefore, to have such a portable net assembly wherein the collapsible telescoping post assembly including an anchoring spike and all or a portion of the net could be completely stored within an enclosing housing and from which housing the post and net may be readily extended for use with the housing or housings remaining attached as an integral part of the net assembly. Such an assembly should desirably be lightweight to enhance portability, yet strong enough when fully deployed to support and retain the net in a sufficiently taut condition.

SUMMARY OF THE INVENTION

In accordance with the present invention, a portable net and net support apparatus for volleyball and similar games comprises a completely self-contained construction which includes a pair of hollow tubular housings within each of which there is mounted a multisection telescoping post assembly in a stored position. The post assembly is extensible from the housing through one open end to a deployed position. The post assembly includes an upper post section journaled for rotation and secured against relative axial movement within the tubular housing and on a common longitudinal axis therewith. An intermediate post section is disposed coaxially within and extensible from the upper post section. A lower post section is disposed coaxially within and is extensible from the intermediate post section. Locking means are provided on the adjoining ends of each of the post sections comprising the post assembly in the extended deployed position for releasably securing the post assembly against relative axial collapsible movement. Each of the tubular housings is provided with a longitudinal slot extending substantially the full length thereof and parallel to the common axis of the housing and the post assembly. A net is attached at one end to each upper post section and, in a net storing position, is at least partially rolled around the outer surface of the upper post section within the tubular housing. The net extends through the slot in each of the housings so that the net may be unrolled from the upper post sections and fed through the slots as the housings are moved relatively away from one another to a net deploying position. Net rolling means are also attached to the upper post section on the opposite end and externally of the housing for manually rolling the net back to the net storing position around the upper post section. A threaded anchor spike is journaled for rotation within and extends axially from the lower free end of the lower post section. Means are also provided for rotating the anchor spike relative to the post assembly and housing to drive the spike into the ground.

When the post assembly is in the stored position, the anchor spike is disposed with the lower post section completely within the housing. Removable closure means is also provided for closing the open end of the housing when the post assembly is stored therein. The closure means preferably comprises an end cap threadably attachable to the open end of the assembly.

A demountable handle is attachable to the anchor spike for manually turning the spike into the ground. The spike handle preferably comprises a rigid handle pin which is insertable into a bore in the anchor spike generally normal to the axis thereof and adjacent the free end of the lower post section.

The net is preferably carried by a pair of parallel upper and lower supporting bands, each of which has a length greater than the length of the net and extends through the slots in the housings for attachment to the upper post sections. Means are provided on the upper and lower edges of the net for attaching the same to the supporting cords. The attaching means may comprise a sewn connection, heat sealing, adhesive or the like.

The means for rolling the net into the housing comprises a second end cap which is journaled for rotation with the upper post section in the opposite upper end of the housing.

The means for locking the adjoining ends of each of the post sections in the extended deployed position preferably comprises a twist lock mechanism, but may also utilize a spring biased locking mechanism. A hinged harness may be used to attach the two housings together when the assembly is fully stored. The harness preferably includes a connecting pin which serves as a carrying handle, is removed to open the harness, and provides a lever for turning the anchor spike. Each of the housings may also include a guy line assembly supporting a retractable guy line with spikes attached to each end.

BRIEF DESCRIPTION OF THE DRAWINGS

FIG. 1 is a perspective view of the portable net assembly of the present invention shown fully deployed.

FIG. 2 is a perspective view of the net assembly shown in FIG. 1 after all parts have been retracted into their stored positions and the housings closed and attached together for transport or storage.

FIG. 3 is a sectional view through the assembly shown in FIG. 2.

FIG. 6 is an enlarged detail of the slot and notch arrangement providing extension and collapse of the lower section of the leg assembly.

FIG. 8 is an enlarged detail of an alternate embodiment showing an optional guy line storage and deployment device.

FIG. 9 is an enlarged vertical section through the guy line storage device shown in FIG. 8.

DETAILED DESCRIPTION OF THE PREFERRED EMBODIMENT

Figure 4:
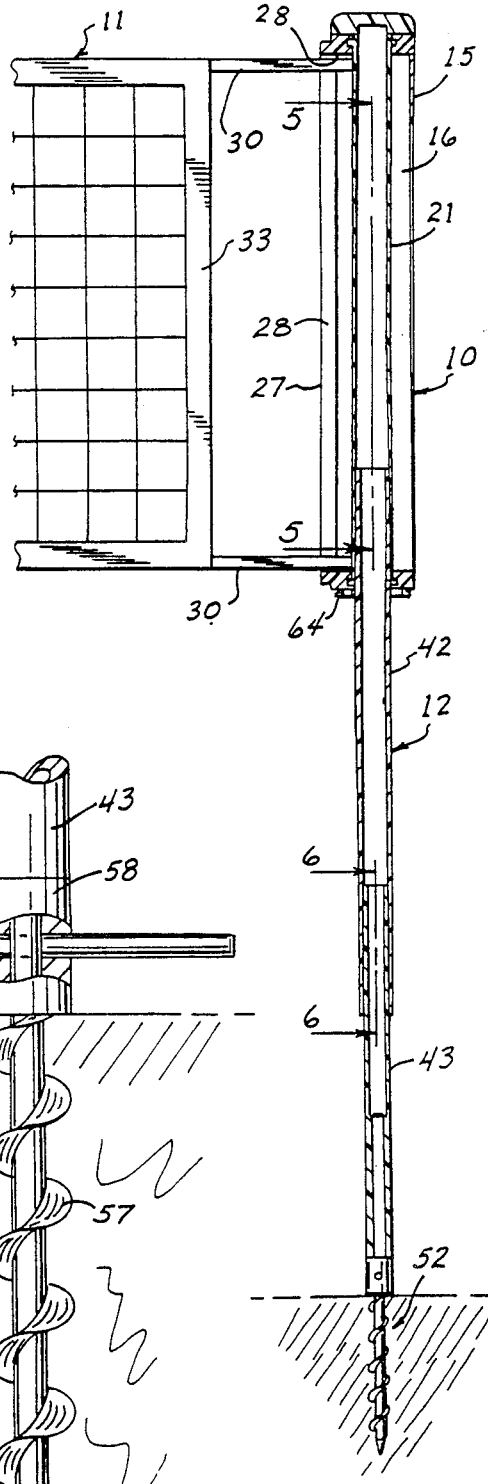
FIG. 4 is a sectional view similar to FIG. 3 showing the net and post assembly in their fully deployed positions.

Referring initially to FIGS. 1 and 2, the portable net and net supporting apparatus of the present invention includes a pair of identical generally cylindrical housings 10 within which the entire volleyball net 11 and a multi-section telescoping post assembly 12 may be conveniently stored and from which they may be deployed to set up and use the net. Each of the cylindrical housings 10 includes a lower end cap 13 which is attached to enclose the post assembly 12 in the housing when the former is collapsed in a telescoping manner, and which cap 13 is removed to open the housing when it is desired to deploy the post assembly. In the collapsed and stored position shown in FIG. 2, the apparatus includes a harness assembly 14 for attaching both housings together in a manner such that the net 11 extending between them is completely enclosed. Details of the apparatus will now be described, including the alternate embodiment of FIG. 8 which provides an alternate guy line storage and deployment device.

Referring also to FIGS. 3 and 4, all of the major components of the assembly of the present invention are preferably made from a thermoplastic material such as, for example, NORYL thermoplastic resin made by General Electric Corporation. Certain of the plastic components may also be suitably reinforced to enhance their strength, particularly elements of the telescoping post assembly 12.

Each of the two housings 10 comprises a pair of semicylindrical members 15 which are joined to define the cylindrical housing 10 having a generally open interior 16 between upper and lower end flanges 18 and 20, respectively. The semicylindrical members 15 are suitably joined with pin connections 17 in the end flanges 18 and 20.

The post assembly 12 comprises a three-piece telescoping arrangement which, in the stored position, is completely contained with the housing 10. The post assembly 12 includes a hollow tubular outer member which comprises the upper end of the post assembly and remains stored within the housing 10. The tubular outer member 21 has a pair of integral annular flanges 22 and 23 on its upper and lower ends which are adapted to be received, respectively, in upper and lower annular slots 24 and 25 formed in the upper and lower end flanges 18 and 20 in the housing 10. In this manner, the tubular outer member 21 is journaled for rotation within the housing 10, but is restrained from axial movement with respect to the housing. The outer diameter of the tubular outer member 21 is substantially smaller than the inside diameter of the housing 10 such that the open interior 16 comprises a rather voluminous annular cylindrical space. The upper end of the tubular outer member 21 includes an integral end cap 26 which is disposed closely adjacent the end face of the upper end flange 18 and has a diameter approximately equal to the outer diameter of the housing 10. The end cap 26 is provided with a suitably grooved outer surface so that it may be readily grasped by hand to turn the outer tubular member 21 on its axis within the housing 10.

Each of the semicylindrical housing members 15 includes a lip 27 extending axially along one edge between the end flanges 18 and 20. When the semicylindrical housing members 15 are joined to form the housing 10, the overlapping lips 27 define a longitudinal slot 28 which extends substantially the full length of the housing and is disposed parallel to the common axis of the housing and the tubular outer member 21. Each end of the net 11 extends through the slot 28 in one of the housings 10 and is attached to the rotatable tubular member 21 such that it may be rolled around the tubular member and into the open interior 16 in the housing 10 by turning the upper end cap 26.

Figure 11:
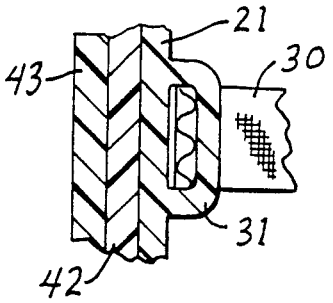
FIG. 11 is an enlarged detail of the connector for the net.

The net 11 is preferably bounded along its upper and lower edges by a pair of bands 30 which run the full length of the net and extend a short distance beyond the ends thereof. The ends of each of the bands 30 extend through the slot 28 in one of the housings 10 for attachment to the tubular outer member 21. Attachment of the band may be effected by passing the band through a small flat loop 31 molded integrally into the outer surface of the outer tubular member 21, folding the end of the band back on itself, and attaching the overlapping portion with a rivet, stitching, or the like. A detail of the attachment is shown in FIG. 11. The ends of the net are also preferably enclosed by end bands 33 which, like the upper and lower longitudinal bands 30, may be attached to the net in any convenient manner such as by sewing, heat sealing, or adhesives.

The preferred manner of storing the net 11 within the housings 10 is to roll approximately one-half the length of the net into each housing. In this manner, the volume of the open interior 16 for storage of the net may be kept to a minimum and, therefore, the diameters of the housings may also be kept to a minimum. As the halves of the net are rolled into the housings the lips 27 defining the slots 28 will come into abutting relation, as shown in FIG. 3. In this fully stored position, the housings 10 may be enclosed within a harness 34 to facilitate storage and transport. The harness comprises a pair of plastic webs 35 which define generally a figure eight in cross section and are connected at one end with a hinge pin 36 allowing the harness to be closed around the adjoining housings 10. The opposite end of the harness is closed to secure the housings together by a removable anchor pin 37. Each of the lips 27 of the adjoining housings 10 is provided with a raised portion 38, which portions abut when the housings are brought together for storage and are received together in a retaining slot 40 in the narrow center portion of the harness 34. In this manner, the harness is retained against axial movement along the enclosed housings 10 after the ends of the harness have been attached with the anchor pin 37. The ends of the harness webs 35 which mount the anchor pin 37 are provided with cooperating pin-receiving ears 41 which define aligned mounting holes in the closed position through which the anchor pin 37 may be inserted. The pinned connection is spaced from the outside of the housing 10 to define an opening 39 which provides a 15 convenient carrying handle.

Figure 5:
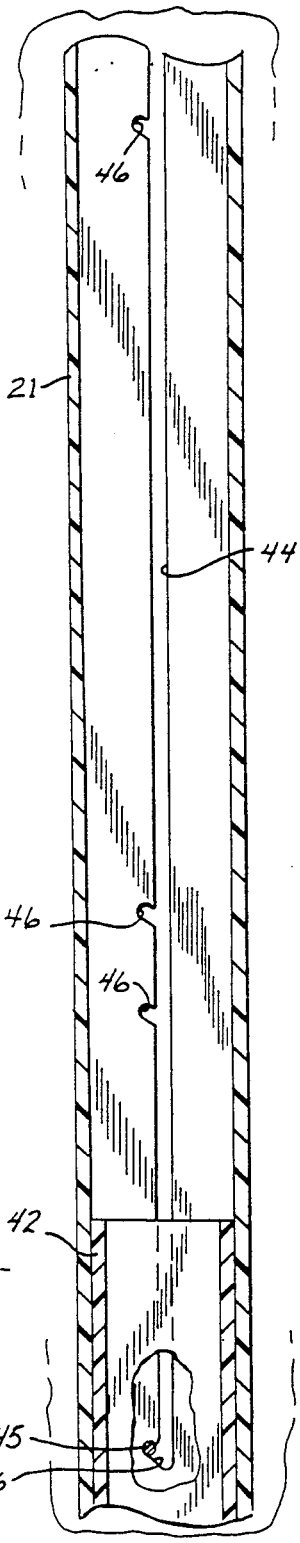
FIG. 5 is an enlarged detail of the height adjustment slot in the post assembly.
Figure 7:
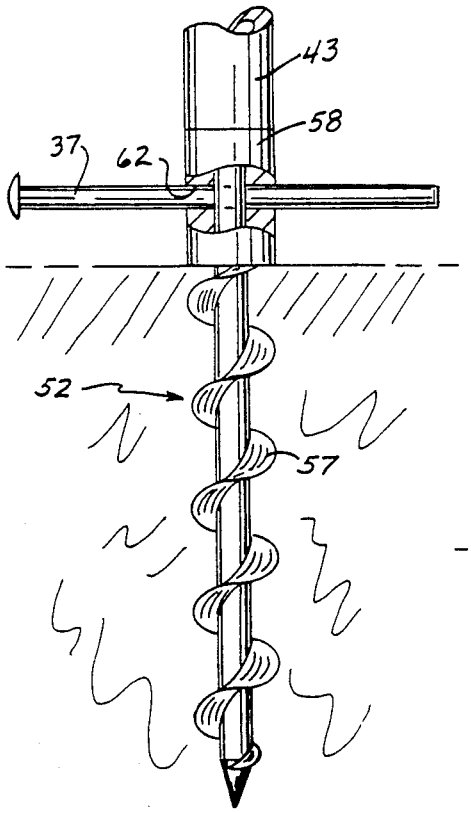
FIG. 7 is an enlarged detail of the anchoring spike attached to the lower portion of the leg assembly.

Referring also to FIGS. 5 and 6, the post assembly 12 includes, in addition to the tubular outer member 21 disposed within the housing 10, an intermediate tubular member 42 and an inner tubular member 43. Intermediate tubular member 42 is constructed and mounted to telescope into the outer tubular member 21 and, similarly, the inner tubular member 43 is constructed to telescope into intermediate tubular member 42. In their fully extended deployed positions, the intermediate tubular member and inner tubular member comprise, respectively, the intermediate section and the lower section of the post assembly 12. The housing 10 and tubular members 21, 42 and 43 all share a common longitudinal axis.

As indicated and referring particularly to FIGS. 4 and 5, the intermediate tubular member 42 telescope into and out of the outer tubular member 21. In the extended deployed position of the post assembly 12, means must be provided to lock the adjoining overlapping ends of the tubular members to maintain the net at the proper height and prevent collapse of the post assembly. The inside surface of the outer tubular member 21 is provided with a longitudinal groove 44 extending along a major portion of the length thereof and parallel to the common axis of the assembly. A complimentary cylindrical protrusion 45 extends outwardly from the surface of the intermediate tubular member 42 and is disposed in the longitudinal groove 44 to slide therein as the intermediate tubular member is telescoped into and out of the outer tubular member 21. In the preferred embodiment of the invention, the portable net assembly is adapted to be positioned at various fixed heights to accommodate use of the net for men's, women's and children's volleyball, each of which requires a different net height. The longitudinal groove 44 is provided at selected positions with a series of upwardly angled short slots 46. Each of the slots 46 is positioned to establish a selected net height such that with the cylindrical protrusion 45 positioned adjacent one of the slots 46, the intermediate tubular member 42 is turned slightly with respect to the outer tubular member 21 to allow the protrusion to enter the slot and to be locked therein by the weight thereof of the upper portion of the assembly. To help locate the cylindrical protrusion 45 in the proper slot 46 for desired net height, the outer surface of the intermediate tubular member 42 may be provided with suitable markings or indicia which, when aligned for example with the lower outer end 47 of the outer tubular member 21, will provide a correct indication of alignment of the protrusion 45 with any one of the slots 46.

In a somewhat similar manner, the inner tubular member (comprising the lower post section of the post assembly 12) is mounted for sliding movement along the common axis into and out of the intermediate tubular member 42. Referring also to FIG. 6, the inside surface of the intermediate tubular member 42 is provided with a longitudinal groove 48 which extends the major portion of its length and is disposed parallel to the common axis of the tubular members. The outer surface of the inner tubular member 43 is provided with a cylindrical protrusion 50 near the upper end which is received for sliding movement in the groove 48. Longitudinal groove 48 includes at its lower end an upwardly angled locking slot 51 into which the cylindrical protrusion 50 may be moved with a slight turning movement to lock the overlapping ends of tubular members 42 and 43 in the fully extended position. Thus, inner tubular member 43 is adapted to move between its fully extended position locked in the locking slot 51 and a fully collapsed position substantially within the intermediate tubular member 42. However, it is to be understood that the series of upwardly angled locking slots 46 in the outer tubular member 21 could as well be used with the groove 48 in the intermediate tubular member 42 such that height adjustment would be effected by relative positioning of the inner member 43 with respect to the intermediate member 42.

A post anchoring screw 52 is attached to the lower end of the inner tubular member 43 in a manner such that it may rotate on the axis of the tubular member 43 (and the common axis of the assembly), but is restrained from axial movement with respect thereto. The ID of the inner tubular member 43 is provided with a lower ID portion 53 and a slightly larger upper ID portion 54 such that the junction of the upper and lower ID portions defines an annular shoulder 55. The anchoring screw 52 includes a cylindrical stub shaft 56 on one end and a screw 57 on the opposite end which are separated by an integral intermediate hub 58. The stub shaft 56 has an axial length approximately equal to the length of the lower ID portion 53 of tubular member 42 and a diameter just slightly smaller than the diameter of the lower ID portion 53. Thus, when the stub shaft 56 is inserted into the lower ID portion 53, the intermediate hub 58 will engage the lower end of the tubular member 43 to locate the end of the stub shaft 56 adjacent the shoulder 55. An annular retaining cap 60 having a diameter larger than the lower ID portion 53 and slightly smaller than the upper ID portion 54 is attached to the end of the stub shaft 56 with a retaining screw 61 to rotatably secure the anchoring screw 52 in the end of the inner tubular member 43. In this manner, the anchoring screw 52 may be turned on the common axis of the assembly to drive the screw into the ground without the necessity of rotating the entire post assembly 12 and housing 10. The anchoring screw hub 58 is provided with a through bore 62 perpendicular to the common axis of the assembly into which the anchor pin 37 removed from the harness 34 may be inserted to provide the necessary leverage to drive the anchoring screw into the ground.

The total length of the inner tubular member 43 and the screw 57 and screw hub 58 extending from the end of the member is approximately equal to the overall length of the intermediate tubular member 42. In this manner, the entire inner tubular member 43 and attached anchoring screw 52 may be telescoped into the intermediate tubular member 42 and that subassembly, in turn, telescoped into the outer tubular member 21 within the housing 10. By virtue of the engagement between the grooves 44 and 48 and the respective cylindrical protrusions 45 and 50, intermediate tubular member 42 and inner tubular member 43 will always rotate along with the outer tubular member 21 (as when the net is rolled up or unrolled). However, the anchoring screw 52 is always free to rotate in its journaled position in the lower end of the inner tubular member 43. This is important because at least one housing 10 and attached post assembly 12 must be anchored into the ground after the opposite housing and post assembly has already been anchored. Similarly, the anchoring screw 52 must be independently rotatable to remove it from the ground when taking the net down.

The lower end of the housing 10 is provided with an annular lip 64 which is adapted to receive the closing end cap 13 to close the housing an retain the collapsed post assembly 12 therein. Preferably, the end cap 63 includes a complimentary annular lip 66 configured to provide a simple quarter turn closure.

Referring now to FIGS. 8 and 9, although the rigid tight fitting construction of the housing and post assembly of the present invention is intended under ordinary conditions to provide a wholly self-supporting net assembly, certain conditions of use may not provide adequate support for the anchoring screws 52 to keep the deployed net taut and prevent sagging. In the alternate embodiment shown in FIG. 8, the upper end of each housing 10 opposite the slot 28 and adjacent the upper end cap 13 is provided with a guy line assembly 65. A pair of spikes 68 are attached to the ends of a guy line 70 which is reeled around a spool enclosed in a guy line housing 67. Preferably, the guy line spool is provided with an interior torsion spring which is wound as the guy line is pulled out for deployment to provide a bias to automatically reel the guy line back around the spool when the spikes 68 are removed from the ground. The guy line assembly includes a retaining slot 71 below the guy line housing 67 into which the spikes 68 may be inserted for storage when not in use. When pulled out for use, the guy line 70 is fully extended from the housing 67 and the spikes inserted or driven into the ground.

Figure 10:
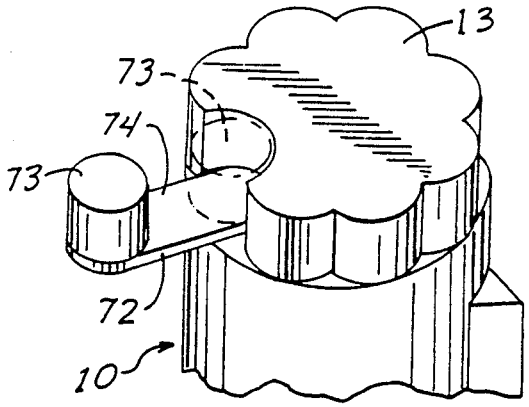
FIG. 10 is an enlarged perspective view of the upper end of one of the housings showing an alternate end cap for winding the net.

In an alternate embodiment shown in FIG. 10, the upper end cap 13 includes an extensible crank 72 which may be withdrawn radially from the body of the cap. The crank 72 includes a handle 73 with a cylindrical body conforming to the scallopped pattern of the end cap. The handle is attached to the end of a slide arm 74 which may be moved along a radial slot (not shown) in the end cap to withdraw the crank 72 for winding or reeling the net From its fully stored position within the two housings 10 attached by the harness 34, the entire net assembly of the present invention is easily and quickly deployed in a fully operative position at any one of the four selected net heights. The harness 34 is first removed by pulling the anchor pin 37 from the ears 41, removing the closing end cap 63 from the lower end of one of the housings 10 and extending the post assembly by pulling the anchoring screw 52 axially from the housing until the cylindrical protrusion 50 on the inner tubular member 43 bottoms in the groove 48 in the intermediate tubular member 42. A slight twist locks the protrusion in the locking slot 51. The inner tubular member 42 may then be axially extended from within the outer tubular member 21 to the selected position of the desired net height and locked in position by turning the cylindrical protrusion 45 on the intermediate tubular member 42 into the appropriate angled slot 46 in the groove 44, as previously described. With the post assembly 12 fully extended, the anchor pin 37 is inserted into the through bore 62 in the anchoring screw hub 58 and the screw turned into the ground, preferably until the hub is at ground level. The other housing 10 is then pulled away from the housing anchored in the ground to deploy the net halves from within both housings. When the net is fully extended, the other housing may be opened, the post assembly extended as indicated, and the second anchoring screw 52 driven into the ground utilizing the anchor pin 37 for leverage. If the guy lines are found to be necessary, they may then be deployed as previously described. Simple reversal of the deployment procedure allows the net to be quickly and easily returned to storage. The stored net assembly of the present invention is light enough to be easily carried by one person and of a size to conveniently fit in the trunk of a car or the like. Each of the housings 10, for example, may have an OD of about $3\frac{1}{2}$ to 4 inches and an overall length of approximately $3\frac{1}{2}$ feet. A net having a standard height of 39 inches may be utilized. However, in order to minimize the volume of the open interior 16 of the housing for net storage, it is desirable to utilize a net constructed with cords of a smaller diameter than those typically used for a volleyball net. Thus, cords of 1/16th inch diameter are preferable over the $\frac{1}{8}$th inch diameter cords used in a standard net.

Various modes of carrying out the present invention are contemplated as being within the scope of the following claims particularly pointing out and distinctly claiming the subject matter which is regarded as the invention.

I claim:

1. A portable net and net support apparatus for volleyball and the like comprising:

a pair of hollow tubular housings;

a multi-section telescoping post assembly disposed in a stored position within each tubular housing and extensible from the stored position through an open end of the housing to a deployed position;

said post assembly including an upper post section journaled for rotation and secured against relative axial movement within said housing on a common longitudinal axis;

an intermediate post section disposed within and extensible from said upper section on said common axis;

a lower post section disposed within and extensible from said intermediate section on said common axis;

locking means on the adjoining ends of each of the post sections in the deployed position for releasably securing the post assembly against relative movement along said common axis;

a longitudinal slot in said tubular housing, said slot extending substantially the full length thereof and disposed parallel to said common axis;

a net attached at one end to and at least partially rolled around the outer surface of said upper post section in each tubular housing in a net storing position;

said net extending through the slot in each of said housings such that said net is unrolled from said upper post section and fed through said slots as said housings are moved relatively away from one another to a net deploying position;

net rolling means attached to said upper post section on the opposite end and externally of said housing for manually rolling the net from said net deploying position to said net storing position;

a threaded anchor spike journaled for rotation on said common axis in and extending axially from the free end of said lower post section; and, means for rotating said anchor spike relative said housing and post assembly.

2. The apparatus as set forth in claim 1 wherein said anchor spike is disposed entirely within said housing with the post assembly in the stored position.

3. The apparatus as set forth in claim 2 including removable closure means for closing the open end of said housing with the post assembly in the stored position.

4. The apparatus as set forth in claim 3 wherein said closure means comprises an end cap threadably attachable to said open end.

5. The apparatus as set forth in claim 1 including handle means demountably attachable to said anchor spike for manually turning said spike into the ground.

6. The apparatus as set forth in claim 5 wherein said handle means comprises:

a bore in said anchor spike generally normal to said common axis and adjacent the free end of said lower post section; and, a rigid handle pin insertable into said bore.

7. The apparatus as set forth in claim 1 wherein said net includes a pair of parallel upper and lower net supporting bands, each having a length greater than the length of said net, each band extending through the slots in said housings and attached by its ends to said upper post sections, and means for attaching said net to said bands.

8. The apparatus as set forth in claim 1 wherein said net rolling means comprises a second end cap journaled for rotation with said upper post section in said opposite end of said housing.

9. The apparatus as set forth in claim 1 wherein said locking means comprises:

a longitudinal groove in the surface of one of each pair of adjoining post sections, said groove extending parallel to said common axis and substantially the full length of said one post section;

an upwardly angled slot opening into said groove at the deployed position; and, a locking protrusion on the adjacent surface of the other of each pair of adjoining post sections, said protrusion lying within and movable along said groove in response to relative axial movement of said adjoining post section between the stored and deployed positions and into said angled slot in response to relative rotational movement between said post sections.

10. The apparatus as set forth in claim 9 wherein one of said longitudinal grooves is provided with a series of axially spaced upwardly angled slots positioned to establish selectively variable net heights.

11. The apparatus as set forth in claim 1 further comprising:

a hinged harness adapted to surround and attach together the tubular housings with the net stored therein and with the net deploying slots in aligned abutment; and, an anchor pin demountably attached to the harness to secure the harness around the housings.

* * * * *